United States Patent [19]

Mey et al.

[11] Patent Number: 5,053,304

[45] Date of Patent: Oct. 1, 1991

[54] PHOTOCONDUCTOR ELEMENT FOR MAKING MULTIPLE COPIES AND PROCESS FOR USING SAME

[75] Inventors: William Mey; Susan E. Riblett; Orville C. Rodenberg, all of Rochester, N.Y.

[73] Assignee: Eastman Kodak Company, Rochester, N.Y.

[21] Appl. No.: 457,675

[22] Filed: Dec. 27, 1989

[51] Int. Cl.[5] ..... G03G 5/047; G03G 5/14

[52] U.S. Cl. ..... 430/59; 430/56; 430/60; 430/64

[58] Field of Search ..... 430/59, 64

[56] References Cited

U.S. PATENT DOCUMENTS 4,063,943 12/1977 Von Hoene et al. .
4,071,361 1/1978 Marushima .
4,127,412 11/1978 Rule et al. .
4,175,960 11/1979 Berwick et al. ..... 430/58
4,297,422 10/1981 Sato ..... 430/54
4,442,191 4/1984 Nishikawa ..... 430/55

*Primary Examiner*—Roland Martin
*Attorney, Agent, or Firm*—Dressler, Goldsmith, Shore, Sutker & Milnamow, Ltd.

[57] ABSTRACT

A photoconductor element is provided that has non-blurring latent image keeping memory which is suitable for multiple electrophotographic copying from a single imaging step. The element preferably incorporates a charge generation layer which comprises a phthalocyanine dye or pigment. The copying method involves simultaneous application of corona charge and an image exposure to the element followed by uniform irradiation of the element. Thereafter a plurality of copies can be made by the step sequence of toner deposition, toner transfer, and toner heat fusion to a receiver.

5 Claims, No Drawings

PHOTOCONDUCTOR ELEMENT FOR MAKING MULTIPLE COPIES AND PROCESS FOR USING SAME

FIELD OF THE INVENTION

This invention is in the field of making multiple electrophotographic copies from a single imagewise exposure of a photoconductor element.

BACKGROUND OF THE INVENTION

Conventionally, after corona charging a single imagewise exposure of a photoconductor element, the latent image produced is developed into a visible toned image that is then electrostatically transferred to a receiver sheet and heat fused thereto.

It has been found that a plurality of high quality toned images cannot be produced from such a single imagewise exposure by repeating the subsequent step sequence of toner development, electrostatic transfer, and heat fusion.

A latent image can be produced within the photoconductor layer that is not erased when the layer is subsequently exposed to uniform overall light, if a suitably charged photoconductor element at the time of imagewise light exposure thereof is simultaneously subjected to corona charging, (see, for example, U.S. Pat. Nos. 4,063,943; 4,071,361; 4,297,423; and 4,442,191). When this procedure is followed, it is found that the photoconductor stores the latent image. Thus, multiple electrophotographic copies can be made using the known step sequence of toner development, electrostatic transfer, and heat fusion.

However, when this procedure is followed to produce a recorded latent image in a photoconductor element, successive copies of the image display increasingly blurred images. The latent image blurring is caused by image spreading in the photoconductor element.

It is presently theorized (and there is no intent herein to be bound by theory) that the reason for blurring is that nonuniform electric fields exist in the photoconductor element that cause the charge carrier therein to move both towards the free surface, to neutralize the surface charge, as well as laterally, to cause image spreading. Under uniform light exposure through the photoconductor element support, and for photogeneration of charge carriers near the edge of a character or line in an image, electrons and holes move laterally leading to the image spreading. Away from these edges, the electric fields are more uniform and the holes and electrons move perpendicularly to the film surface. If the uniform overall exposure is continued for a sufficiently long time period, the entire interface in the region between the photoconductive layer and the conductive layer will be driven to equipotential. However, if the uniform overall exposure is absorbed near the free (or imaged) surface, then no horizontal field exists, and hence no lateral image spreading occurs.

So far as now known, no photoconductor element is capable of being used in this process without the occurrence of the blurred image phenomenon during efforts to make multiple electrophotographic copies.

SUMMARY OF THE INVENTION

This invention is directed to a class of new photoconductor elements that can be utilized to make a plurality of copies from a single latent image that is formed by a single step of charging and concurrently imaging.

Latent images formed in such a photoconductor element do not blur during the making of multiple electrophotographic copies therefrom as taught herein.

In addition, the photoconductor elements of this invention exhibit high speed, excellent latent image keeping (LIK) memory, and sensitivity in both the visible and infrared spectral regions. Such elements can also be readily erased and reused.

This invention is further directed to a process for using such photoconductor elements to make a plurality of copies from a single latent image formed and stored therein. This process utilizes a type of corona-charge/image and uniform exposure process.

The process is relatively simple, reliable, and economical.

Various other features, advantages, aims, purposes, embodiments, and the like of this invention will be apparent to those skilled in the art from the present specification and appended claims.

DETAILED DESCRIPTION

(a) The Photoconductor Element

A photoconductor element of this invention is capable of producing a number of high resolution copies from a single imagewise exposure thereof using the electrophotographic procedure taught herein. The element utilizes a multi-active photoconductor segment that comprises a charge transport layer and a charge generation layer. The photoconductor is contiguous to an electrically insulating layer that is bonded to a conductive layer. The photoconductor is theorized to function by trapping charges therein adjacent the interface between the insulating layer and the photoconductor to prevent lateral movement, and by allowing a charge of opposite polarity to migrate away from such interface to neutralize an outside surface charge.

Such a photoconductor element comprises a plurality of layers that can be separate or combined, as follows:

(a) a charge transport layer;
(b) a charge generation layer;
(c) an adhesive layer;
(d) a solvent holdout layer;
(e) an electrically insulating layer;
(f) an electrically conductive layer; and
(g) a support layer.

The charge transport layer comprises on a 100 weight percent dry solids basis:

about 20 to about 60 weight percent of at least one aromatic amine hole transport agent; and about 40 to about 80 weight percent of an electrically insulating, film forming organic polymeric binder. Preferably, such layer contains one or more aromatic amines that contain at least three aryl moieties.

In general, any of the aromatic amines that are known to the art to function as hole transport agents can be used in the practice of the present invention.

One presently preferred class of amines is taught in U.S. Pat. No. 4,127,412 which is incorporated herein by reference and identifies amines having the structure:

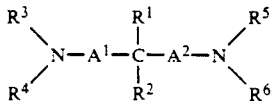

wherein:

$R^1$ and $R^2$, which may be the same or different, represent, when taken separately, (i) hydrogen, (ii) an unsubstituted alkyl group or substituted alkyl group having 1 to about 18 carbon atoms, said substituted alkyl having a substituent selected from the group consisting of alkoxy, aryloxy, amino, hydroxy, aryl, alkylamino, arylamino, nitro, cyano, halogen, and acyl or (iii) when taken together, $R^1$ and $R^2$ represent the saturated carbon atoms necessary to complete a cycloalkyl ring having 3 to 10 carbon atoms in the cycloalkyl ring, $R^3$, $R^4$, $R^5$, and $R^6$, which may be the same or different, each represent an unsubstituted or substituted aryl group having a substituent selected from the group consisting of alkyloxy, aryloxy, amino, hydroxy, alkylamino, arylamino, nitro, cyano, halogen, alkyl, and acyl; and $A^1$ and $A^2$, which may be the same or different, represent an unsubstituted phenyl group or a substituted phenyl group having the substituents defined for $R^3$, $R^4$, $R^5$, and $R^6$ above.

Typically $R^1$ and $R^2$ represent an alkyl group having 1 to 18 carbon atoms, e.g., methyl, ethyl, propyl, butyl, isobutyl, dodecyl, etc. including a substituted alkyl group having 1 to 18 carbon atoms such as:

a. alkoxyalkyl, e.g. ethoxypropyl, methoxybutyl, propoxymethyl, etc.;
b. aryloxyalkyl, e.g. phenoxyethyl, napthoxymethyl, phenoxypentyl, etc.;
c. aminoalkyl, e.g. aminobutyl, aminoethyl, aminopropyl, etc.;
d. hydroxyalkyl, e.g. hydroxypropyl, hydroxyoctyl, etc.;
e. aralkyl, e.g. benzyl, phenethyl, etc.;
f. alkylaminoalkyl, e.g. methylaminopropyl, methylaminoethyl, etc.; and also including dialkylaminoalkyl e.g. diethylaminoethyl, dimethylaminopropyl, etc.;
g. arylaminoalkyl, e.g., phenylaminoalkyl, N-phenyl-N-ethylaminohexyl, naphthylaminomethyl, etc.;
h. nitroalkyl, e.g. nitrobutyl, nitroethyl, nitropentyl, etc.;
i. cyanoalkyl e.g. cyanopropyl, cyanobutyl, cyanoethyl, etc.;
j. haloalkyl, e.g. chloromethyl, bromopentyl, chlorooctyl, etc.; and
k. alkyl substituted with an acyl group having the formula $$-\overset{\overset{\displaystyle O}{\|}}{C}-R$$

wherein R is hydroxy, hydrogen, aryl, e.g., phenyl, naphthyl, etc. lower alkyl having one to eight carbon atoms, e.g. methyl, ethyl, propyl, etc., amino including substituted amino, e.g. diloweralkylamino, lower alkoxy having one to eight carbon atoms, e.g. butoxy, methoxy, etc., aryloxy, e.g., phenoxy, naphthoxy, etc.

Typically, $R^3$, $R^4$, $R^5$ and $R^6$ represent an aryl group, e.g., phenyl, naphthyl, anthryl, etc., including a substituted aryl group such as:

a. alkoxyaryl, e.g., ethoxyphenyl, methoxyphenyl, etc.;
b. aryloxyaryl, e.g., phenoxyphenyl, naphthoxyphenyl, phenoxynaphthyl, etc.;
c. aminoaryl, e.g. aminophenyl, aminonaphthyl, aminoanthryl, etc.;
d. hydroxyaryl, e.g. hydroxyphenyl, hydroxynaphthyl, etc.;
e. biphenylyl;
f. alkylaminoaryl, e.g., methylaminophenyl, methylaminonaphthyl, etc.; and also including dialkylaminoaryl, e.g., diethylaminophenyl, dipropylaminophenyl, etc.;
g. arylaminoaryl, e.g., phenylaminophenyl, diphenylaminophenyl, N-phenyl-N-ethylaminophenyl, naphthylaminophenyl, etc.;
h. nitroaryl, e.g., nitrophenyl, nitronaphthyl, nitroanthryl, etc.;
i. cyanoaryl, e.g., cyanophenyl, cyanonaphthyl, cyanoanthryl, etc.;
j. haloaryl, e.g., chlorophenyl, bromophenyl, chloronaphthyl, etc.;
k. alkylaryl, e.g., tolyll, ethylphenyl, propylnaphthyl, etc.; and
l. aryl substituted with an acyl group having the formula:

$$-\overset{\overset{\displaystyle O}{\|}}{C}-R$$

wherein R is hydroxy, hydrogen, aryl, e.g., phenyl, naphthyl, etc., amino including substituted amino, e.g., diloweralkylamino, lower alkyl having one to eight carbon atoms, e.g., butoxy, methoxy, etc., aryloxy, e.g., phenoxy, naphthoxy, etc., lower alkyl having 1 to 8 carbon atoms, e.g., methyl, ethyl, propyl, butyl, etc.

In general, $A^1$ and $A^2$ are unsubstituted when both $R^1$ and $R^2$ represent substituents other than hydrogen.

In the case where $R^1$ and $R^2$ are taken together to form a substituted cycloalkyl, representative substituents which can be present on the cycloalkyl ring include linear or branched chain aliphatic groups having 1 to 10, preferably 1 to 4, carbon atoms. Typical of such aliphatic group substituents are those aliphatic groups having 1 to 10, preferably 1 to 4 carbon atoms, included in the class of substituted and unsubstituted alkyl groups listed hereinabove for $R^1$.

Typical compounds which belong to the general class of photoconductive compounds Formula (1) include the following materials listed in Table I below:

Table I 1,1-Bis(4-di-p-tolylaminophenyl)cyclohexane;
2,2-Bis(di-p-tolylaminophenyl)propane;
4,4-Bis(di-p-tolylamino)-1,1,1-triphenylethane;
4,4'-Bis(di-p-tolylamino)tetraphenylmethane;
Bis(4-di-p-tolylaminophenyl)methane;
Bis(4-di-p-tolylaminophenyl)phenylmethane;
1,1-Bis(4-di-p-tolylaminophenyl)-4-t-butylcyclohexane;
1,1-Bis(4-di-p-tolylaminophenyl)-2-methylpropane;
1,1-Bis(4-di-p-tolylaminophenyl)ethane;
1,1-Bis(4-di-p-tolylamino-2-methylphenyl)ethane; and
1,1-Bis(4-[di-4-tolylaminophenyl)-3-phenylpropane.

Compounds which belong to the general class of Formula (1) compounds described herein and which are especially preferred for use in accordance with the present invention include those compounds having the structural formula shown above wherein $A^1$ and $A^2$ are represent a group other than hydrogen, and preferably $R^1$ and $R^2$ taken together represent the necessary saturated carbon atoms to complete a 6-member cycloalkyl ring; and $R^3$, $R^4$, $R^5$ and $R^6$ are unsubstituted phenyl radicals or alkyl substituted phenyl radicals having no more than two alkyl substituents, said alkyl substituents containing 1 or 2 carbon atoms. These compounds are preferred because of their generally increased thermal stability and because of the high electrical speeds that are obtained from organic photoconductive compositions that contain these compounds.

In charge transport layers of this invention, at least one aromatic amine having a hole transporting group is combined with an electrically insulating organic polymeric binder. Such a binder is typically and perferably an organic solvent soluble, film-forming organic polymer, such as has previously been used in the photoconductor art as a binder. Examples include cellulose nitrate, polyesters, polycarbonates, copolymers of poly(vinylpyrrolidone) and vinylacetate, and various vinylidene chloride-containing polymers, including 2, 3 and 4 component polymers prepared from a polymerizable blend of monomers or prepolymers containing at least 60% by weight of vinylidene chloride. One useful class of binders is comprised of a hydrophobic film-forming polymer or copolymer that is free from any acid-containing group, such as a carboxyl group, and that is prepared from a blend of monomers or prepolymers, each of said monomers or prepolymers containing one or more polymerizable ethylenically unsaturated groups.

Particularly useful are electrically insulating, film-forming polymers having an alkylidene diarylene group in a recurring unit, such as those linear polymers, including copolymers, containing the following group in a recurring unit:

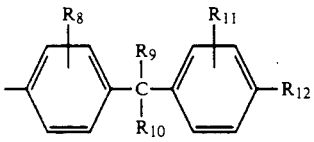

(A)

wherein:

$R_9$ and $R_{10}$ when taken separately, can each be a hydrogen atom, an alkyl group having from one to about 10 carbon atoms, such as methyl, ethyl, isobutyl, hexyl, heptyl, octyl, nonyl, decyl, and the like, including substituted alkyl groups, such as trifluoromethyl, etc., and an aryl group, such as phenyl and naphthyl, including substituted aryl groups having such substituents as a halogen atom, an alkyl group of 1 to about 5 carbon atoms, etc.; and $R_9$ *and* $R_{10}$ when taken together, can represent the carbon atoms necessary to complete a saturated cyclic hydrocarbon group, including cycloalkanes, such as cyclohexyl and polycycloalkanes, such as norbornyl. The total number of carbon atoms in $R_9$ and $R_{10}$, can be up to about 19; $R_8$ and $R_{11}$ can each be hydrogen, an alkyl group of 1 to about 5 carbon atoms, or a halogen such as chloro, bormo, iodo, etc; and $R^1$ is a divalent group selected from the following:

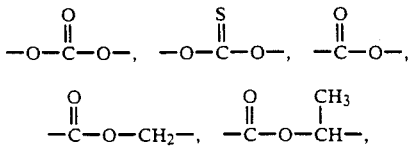

-continued

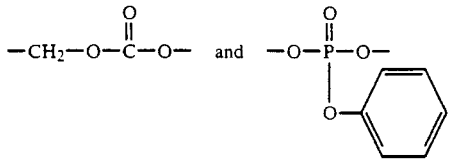

Preferred binder polymers are hydrophobic polyesters or polycarbonates of Structure (A).

In presently preferred charge transport layers of this invention, the binder comprises about 50 to about 60 weight percent thereof with the balance up to 100 weight percent thereof comprising the aromatic amine compound(s).

A charge generation layer is provided which is bonded to the charge transport layer and which has a thickness in the range of about 0.1 to about 5 microns, and preferably in the range of about 0.1 to about 1.0 microns.

The charge transport layer has a dry thickness in the range of about 5 to about 50 microns.

The charge generation layer employs as the sole active agent for photogenerating charge carriers at least one photoconductive phthalocyanine dye pigment.

Examples of suitable photoconductive phthalocyanine dyes and pigments are shown in U.S. Pat. Nos. 4,471,039; 4,701,396; 4,727,139; and 4,666,802.

Examples of preferred phthalocyanine dyes and pigments are bromoindium, phthalocyanine and oxytitanyl tetrafluorophthalocyanine.

An adhesive layer is provided that has a thickness in the range of about 0.1 to about 0.5 microns, and preferably in the range of about 0.2 to about 0.3 microns. The adhesive layer functions to bond the charge generation to the adjacent solvent holdout layer.

The adhesive layer is conveniently comprised of an acrylonitrile-vinylchloride copolymer.

A solvent holdout layer is provided which has a thickness in the range of about 1.0 to about 3.0 microns, and preferably in the range of about 1.0 to about 1.5 microns. The solvent holdout layer functions to prevent chemical mixing of the charge generation layer with the electrically insulating layer, thereby insuring layer integrity.

The solvent holdout layer is conveniently comprised of a GAFGARD TM material which is a crosslinkable, coatable acylate polymer available commercially from GAF Company.

An electrically insulating layer is provided that has a thickness in the range of about 5 to about 30 microns, and preferably in the range of about 10 to about 15 microns. The electrically insulating layer provides a charge barrier between the charge generation layer and the electrically conductive layer.

The electrically insulating layer is conveniently comprised of an organic polymer that can be comprised of the type of polymer that is used as a binder in the charge transport layer. A presently preferred such polymer is bisphenol-A-polycarbonate.

A support layer is provided that has a thickness in the range of about 2 to about 10 mils and preferably in the range of about 3 to about 8 mils. The support layer is self-supporting, and transparent, and is comprised of a film-forming, electrically insulating organic polymer. Many different polymeric materials that have been taught in the art may be used as support layer materials. Presently preferred are polyesters, such as polyethylene terephthalate; polycarbonates; and cellulose acetate.

Typically, the support layer is preformed, and the electrically conductive layer is deposited thereon by a conventional vacuum vapor deposition or solvent coating procedure.

The electrically insulating layer is preferably an organic solvent soluble polymer. Such a polymer is preferably dissolved in the solvent and the solution is coated upon the electrically conductive layer. This coating is then dried in air or the like to produce the desired insulating layer.

Suitable organic coating solvents include aromatic hydrocarbons, such as benzene, toluene, xylene, mesitylene, napthalene, etc.; ketones, such as acetone, 2-butanone, etc.; ethers, including cyclic ethers, such as cyclic ethers, like tetrahydrofuran, and methyl ethyl ether, ethyl ether, petroleum ether, etc; alkanols, such as isopropyl alcohol, etc.; halogenated aliphatic hydrocarbons, such as methylene dichloride, chloroform, an ethylene chloride, etc.; and the like. Presently preferred coating solvents are methylene dichloride and 1,1,2-trichloroethane. Mixtures of different solvent liquids can be employed. Preferably the solvent system used is volatile, that is evaporable, at temperatures below about 50° C.

Suitable coating techniques include knife coating, spray coating, roller coating, or the like. After application, a coated composition is conveniently air dried.

The charge generation layer is either vacuum vapor deposited or solvent or dispersion coated over the adhesive layer.

When solvent or dispersion coating is employed, the phthalocyanine dye or pigment is dissolved or colloidally dispersed in an organic coating solvent with a polymeric binder. Examples of suitable binders include polymers such as above characterized for use in the charge transport layer. Conveniently, a suitable coating solution contains about 1 to about 5 weight percent solids on 100 weight percent solution basis, and the solids comprise on a 100 weight percent solids basis about 50 to about 80 weight percent phthalocyanine dye or pigment, and about 20 to about 50 weight percent binder polymer. Various additives may be used if desired, such as coating aids, as for example, polydimethylsiloxane, but the total amount thereof is preferably less than about 0.02 weight percent of the total solution.

Over the charge generation layer, the charge transport layer is applied by solvent coating. The charge-transport agents that are employed in such layer are dissolved in an organic carrier solvent with the binder. After coating the solvent is removed by drying. Conveniently, a suitable coating solution contains about 5 to about 20 weight percent solids on a 100 weight percent solution basis and the solids comprise on a 100 weight percent solids basis about 40 to about 50 weight percent of the indicated combination of such charge-transport agents. Various adjuvants can be used, if desired, in the respective types and amounts above indicated herein in connection with the charge generation layer.

(b) The Copying Processes

The copying method of this invention enables one to make a plurality of copies from a single latent image stored in such a photoconductor element.

Corona charge is applied to the free surface of the photoconductor element while simultaneously exposing said element to a focused light image of an original to produce a latent image of the original. The amount of corona charge applied to the free surface of the photoconductor element can be controlled by a grid-controlled corona charger.

The focused light image is preferably comprised of light having a frequency in the range of about 380 to about 1000 nm, and a maximum intensity in the range of about 10 to about 1000 ergs/cm$^2$.

Thereafter, one uniformly exposes the photoconductor element to light energy.

Preferably, the light energy has a frequency 10 in the range of about 380 to about 1000 nm, an intensity in the range of about 10 to about 1000 ergs/cm$^2$.

Thus a latent image of the original becomes stored in the photoconductor element.

Next, the latent image is developed by electrostatically depositing upon the open face of the photoconductor element toner powder of the appropriate polarity to make either positive or negative appearing images.

Next, the developed image so formed on such face is transferred to a receiver sheet such as bond paper or coated paper.

Thereafter, the transferred toned image is heat fused to the receiver sheet.

In accordance with the invention, using the latent image stored in the photoconductor element, the steps of toner deposition, electrostatic transfer of toned image to receiver sheet, and heat fusion to receiver sheet are repeated in sequence a plurality of times to make multiple copies. Each step sequence repeat utilizes a different receiver sheet.

Conventional toners known to the art can be used.

Next, one electrostatically transfers the developed image from the surface of the photoconductor element to the surface of a receiver sheet.

Receiver sheets known to the art are used. Paper is the presently preferred receiver sheet.

The memory property of the photoconductor elements can be used with different process steps other than the ones exemplified above. For example, a double-charge method can be used, where the first step in the sequence is to corona charge the photoconductor element positively with a concurrent optional blanket light exposure. The result is a uniform positive charge density at the interface between the insulative layer and the charge generation layer due to corona charge injection. This step is then followed by the sequence of steps shown above described using concurrent corona charging and imaging. While this method requires an additional charging step, it permits contrast potential to be increased up to about twice the value achieved with negative biasing. As used herein, the term "contrast potential" means the surface potential difference between exposed and unexposed areas of the photoconductor element.

(c) The Erasing Process

The invention provides further methods for erasing a latent image stored in a photoconductor element of the invention. The method involves applying a grounded grid AC corona charge against the charge transport layer surface relying upon positive charge injection at the film's free surface. An alternate method is to corona charge the film positively and blanket expose the free surface with radiation absorbed by the charge-transport layer. This light has a frequency in the range of about 300 to about 450 nm and an intensity in the range of about 1 to about 1000 ergs/cm$^2$. After such an erasing treatment, the photoconductor can be used again for latent image formation as described herein.

The invention is illustrated by the following examples:

EXAMPLE 1 CONTROL (PRIOR ART)

A control photoconductive element was prepared by solvent coating each successive layer through an extrusion hopper. An electrically insulating layer of Lexan TM 145 (bisphenol-A-polycarbonate) about 10.5 microns thick was coated onto a nickel-coated polyester support from a solution in dichloromethane. A GARFARD TM solvent holdout layer about 1.5 microns thick was coated onto the insulating layer from a solution in methanol, and crosslinked with ultraviolet radiation. Then a conventional aggregate-type composite photoconductor was coated over the solvent holdout layer. Such composite photoconductor consisted of a 4 micron thick charge generation layer and an 8 micron thick charge transport layer. The charge generation layer consisted of 6.5 weight percent 4-(4-dimethylaminophenyl)-2,6-diphenylthiapyrylium hexafluorophosphate, 1.5 weight percent 4-(4-dimethylaminophenyl)-2-(4-ethoxyphenyl)-6-phenylthiapyrylium fluoroborate, 40 weight percent 1,1-bis(di-4-tolylaminophenyl)-cyclohexane, and 52 weight percent bisphenol-A-polycarbonate. It was coated from a solution in a 7:3 mixture of dichloromethane and 1,1,2-trichloroethane. The charge transport layer consisted of 20 weight percent 1,1-bis(di-4tolylaminophenyl)cyclohexane, 20 weight percent 1,1-bis(di-4-tolylaminophenyl)-3-phenylpropane, and 60 weight percent of a polyester of 4,4'-(2norbornylidene)diphenol with 60/40 molar ratio of terephthalate-azelaic acids. It was coated from a solution in a 7:3 mixture of dichloromethane and methyl acetate.

The solvent holdout layer was used to prevent chemical mixing of the aggregate composite photoconductor segment with the Lexan electrically-insulating layer, thereby insuring layer integrity. The mixture of the photoconductors was used in the charge generation layer to facilitate image erasure using corona-charge injection after a multiple copying sequence and before use of the photoconductor element for formation and storage of another latent image.

The photoconductor element was (1) simultaneously charged (AC corona, negative DC grid bias) and imagewise exposed (contact exposure through the conductive support) followed by (2) an overall blanket light exposure (680 nm). The resultant electrostatic latent charge pattern was (3) developed using a magnetic brush with a toner (positively charged) to provide a positive/looking print. The toner powder used was Kodak Ektaprint 250 toner. It was observed that the copied images obtained were blurred, apparently due to lateral-image spreading of the holes and electrons generated by the aggregate layer.

EXAMPLE 2

A photoconductor element of this invention was prepared using a procedure similar to that employed in Example 1, except that the charge generation layer consisted of a 0.15 micron thick layer of vacuum-deposited bromoindium phthalocyanine. The charge transport layer consisted of 40 weight percent 1,1-bis(di-4-tolylaminophenyl)cyclohexane and 60 weight percent bisphenol-A-polycarbonate. The charge transport layer was coated from a solution in a 7:3 mixture of dichloromethane and 1,1,2-trichloroethane, and had a thickness of about 10 microns.

The element was processed as described in Example 1 and it was noted that, while the sensitometry of this element was relatively poor, sharp images were produced and the film could be erased using a grounded grid AC corona (erasure in this manner relies on corona charge injection).

EXAMPLE 3

A photoconductor element of this invention was prepared that was similar to that described in Example 1, except that the charge generation layer was a dispersion of oxytitanyl tetrafluorophthalocyanine in poly(4,4'-(hexahydro-4,7-methanoidan-5-ylidene)-diphenyl carbonate) in a ratio of 2:1. The charge generation layer was coated to a dry thickness of 0.5 microns from a solution in a 4:1 mixture of dichloromethane and 1,1,2-trichloroethane. The charge transport layer consisted of 20 weight percent tri-4-tolylamine, 20 weight percent 1,1-(bis(di-4tolylaminophenyl)cyclohexane, and 60 weight percent of a polyester of 4,4'-(2-norbornylidene)diphenol with 60/40 molar ratio of terephthalic-azelaic acids. The charge transport layer was coated from a solution in a 7:3 mixture of dichloromethane and methyl acetate, and had a thickness of about 10 microns. Full process imaging was not undertaken on this element but "electrical only" measurements were similar to those obtained with the element of Example 2 indicating that this element should also produce sharp images.

EXAMPLE 4

A photoconductor of the invention that was similar to the element of Example 2 was prepared and was surface-treated by rubbing zinc stearate onto the surface to aid toner transfer. The imaging procedure described in Example 1 was used to produce the stored latent image. Such image was then developed with Panasonic Magnefine toner which comprised a negatively-charged toner. Positive/positive development was achieved. Several prints were made from the single imagewise exposure stored in the photoconductor element and the heat fused, copied images on all of the paper receiver sheets were sharp.

The phthalocyanines are believed to effectively trap the charge carriers remaining at the interface between the insulation layer and the charge control layer after blanket exposure (electrons in the case of examples described above).

While the prints obtained in the above examples were monochromatic, to should be understood that the invention may also be used to provide prints of two or more different colors.

The foregoing specification is intended as illustrative and is not to be taken as limiting. Still other variations within the spirit and the scope of the invention are possible and will readily present themselves to those skilled in the art.

We claim:

1. A photoconductor element having nonblurring latent image keeping memory and suitable for multiple electrophotographic copying from a single latent image stored therein comprising:

(a) a charge transport layer that comprises:

(1) about 20 to about 60 weight percent of at least one aromatic amine hole transport agent; and (2) about 40 to about 80 weight percent of an electrically insulating, film forming organic polymeric binder;

(b) a charge generation layer that comprises at least one photoconductive phthalocyanine material;

(c) an adhesive layer;

(d) a solvent holdout layer;

(e) an electrically insulating layer;

(f) an electrically conductive layer; and (g) a support layer.

2. A photoconductor element as in claim 1 wherein the photoconductive phthalocyanine material is bromoindium phthalocyanine.

3. A photoconductor element as in claim 1 wherein the photoconductive phthalocyanine material is oxytitanyl tetrafluorophthalocyanine.

4. A photoconductor element as in claim 1 wherein the aromatic amine hole transport agent is 1,1-bis(di-4-tolylaminophenyl)cyclohexane.

5. A photoconductor element as in claim 1 wherein the aromatic amine hole transport agent is a mixture of tri-4-tolylamine and 1,1-(bis-(di-4-tolylaminophenyl)cyclohexane.

* * * * *

UNITED STATES PATENT AND TRADEMARK OFFICE

CERTIFICATE OF CORRECTION

PATENT NO. : 5,053,304

DATED : October 1, 1991

INVENTOR(S) : Mey et al.

It is certified that error appears in the above-identified patent and that said Letters Patent is hereby corrected as shown below:

Column 4, line 58 After "1,1-Bis(4-di-p-tolylaminophenyl)ethane;", insert -- -1,1-Bis(4-di-p-tolylaminophenyl)-3-methylbutane;--.

Column 4, line 65 After "are", insert --unsubstituted phenyl groups; at least one of $R^1$ and $R^2$--.

Column 5, line 60 "$R^1$" should be --$R_{12}$--.

Column 8, line 12 Delete "10".

Signed and Sealed this

Nineteenth Day of July, 1994

Bruce Lehman

BRUCE LEHMAN

*Commissioner of Patents and Trademarks*

*Attest:*

*Attesting Officer*